US009218925B2

(12) United States Patent
Armendariz et al.

(10) Patent No.: US 9,218,925 B2
(45) Date of Patent: Dec. 22, 2015

(54) KEY INCLUDING SECONDARY DOMES

(75) Inventors: Luis C Armendariz, Spring, TX (US); Earl W Moore, Cypress, TX (US); Joseph A Jones, Montgomery, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 105 days.

(21) Appl. No.: 14/235,378

(22) PCT Filed: Jul. 29, 2011

(86) PCT No.: PCT/US2011/046003
§ 371 (c)(1), (2), (4) Date: Jan. 27, 2014

(87) PCT Pub. No.: WO2013/019194
PCT Pub. Date: Feb. 7, 2013

(65) Prior Publication Data

US 2014/0166459 A1 Jun. 19, 2014

(51) Int. Cl.

| | |
|---|---|
| ***H01H 1/10*** | (2006.01) |
| ***H01H 13/26*** | (2006.01) |
| ***H01H 13/64*** | (2006.01) |
| ***H01H 13/702*** | (2006.01) |
| ***H01H 13/88*** | (2006.01) |

(52) U.S. Cl.
CPC ..... *H01H 13/26* (2013.01); *H01H 13/64* (2013.01); *H01H 13/702* (2013.01); *H01H 13/88* (2013.01); *H01H 2215/006* (2013.01)

(58) Field of Classification Search
CPC ..... H01H 13/26; H01H 13/702; H01H 13/64; H01H 2215/004; H01H 2215/006
USPC ..... 200/512, 513, 515, 516, 517, 344
See application file for complete search history.

(56) References Cited

U.S. PATENT DOCUMENTS

| | | | | |
|---|---|---|---|---|
| 4,256,931 | A | 3/1981 | Palisek | |
| 4,323,740 | A | 4/1982 | Balash | |
| 5,144,103 | A * | 9/1992 | Suwa | 200/344 |
| 5,247,143 | A * | 9/1993 | Suwa | 200/517 |
| 5,565,865 | A * | 10/1996 | So | 341/20 |
| 6,653,586 | B2 | 11/2003 | Hsiung et al. | |
| 7,129,854 | B2 | 10/2006 | Arneson et al. | |
| 7,427,725 | B2 | 9/2008 | Hou et al. | |
| 2005/0227632 | A1 | 10/2005 | Ladouceur | |

FOREIGN PATENT DOCUMENTS

| | | |
|---|---|---|
| JP | 2001052554 | 2/2001 |
| KR | 20070081920 | 8/2007 |

OTHER PUBLICATIONS

International Search Report and Written Opinion received in related PCT Application No. PCT/US2011/046003, mailed on Feb. 29, 2012, 10 pgs.

* cited by examiner

*Primary Examiner* — Renee Luebke
*Assistant Examiner* — Lheiren Mae A Caroc
(74) *Attorney, Agent, or Firm* — HP Legal Department

(57) ABSTRACT

Example embodiments disclosed herein relate to a key including a primary dome, a plurality of second domes, and a first layer. The primary dome is to compress a switch if the primary dome collapses. The first layer is over the primary and secondary domes. The first layer collapses the primary dome and does not engage the secondary domes, if the first layer is pressed substantially levelly or parallel to the rest position.

14 Claims, 2 Drawing Sheets

KEY INCLUDING SECONDARY DOMES

BACKGROUND

Keyboards may be used to transmit user input to a computing device. A manufacturer and/or user may desire a simpler keyboard design in order to reduce manufacturing costs and/or reduce a likelihood of the keyboard becoming damaged.

BRIEF DESCRIPTION OF THE DRAWINGS

The following detailed description references the drawings, wherein.

DETAILED DESCRIPTION

Specific details are given in the following description to provide a thorough understanding of embodiments. However, it will be understood by one of ordinary skill in the art that embodiments may be practiced without these specific details. For example, well-known processes, structures and techniques may be shown without unnecessary detail in order to avoid obscuring embodiments.

Certain types of keyboards include keys having scissor mechanisms. These scissor mechanisms commonly interlock a keycap of to a remaining structure of the key. The scissor mechanism allows for a shorter travel time and/or distance of the key when pressed, and thus the key may be quieter and require less force to press. However, scissor mechanisms increase manufacturing costs as well as a number of parts included in the key. The increased number of parts also increases a likelihood of the key malfunctioning, such as the key becoming jammed. Moreover, a limited movement and increased attachment points of the keycap due to the scissor mechanisms may cause more debris to become lodged under the key as well as increase a difficulty of removing the debris.

Nonetheless, removing the scissor mechanism may, cause the key to become unstable. For example, the key may wobble, jiggle or descend at angle, when pressed by the user. Embodiments may provide a key having less parts while still maintaining a stability of the key. For example, an embodiment of key may include secondary domes surrounding a primary dome. The secondary domes may level a key that is being pressed unevenly. For example, if the user primarily presses down towards the dome layer 110 at a corner of the key, at least one of the secondary domes corresponding to the pressed corner may become engaged, thus preventing the key from being pressed unevenly or reducing a degree at which the key is pressed unevenly.

Figure 1:
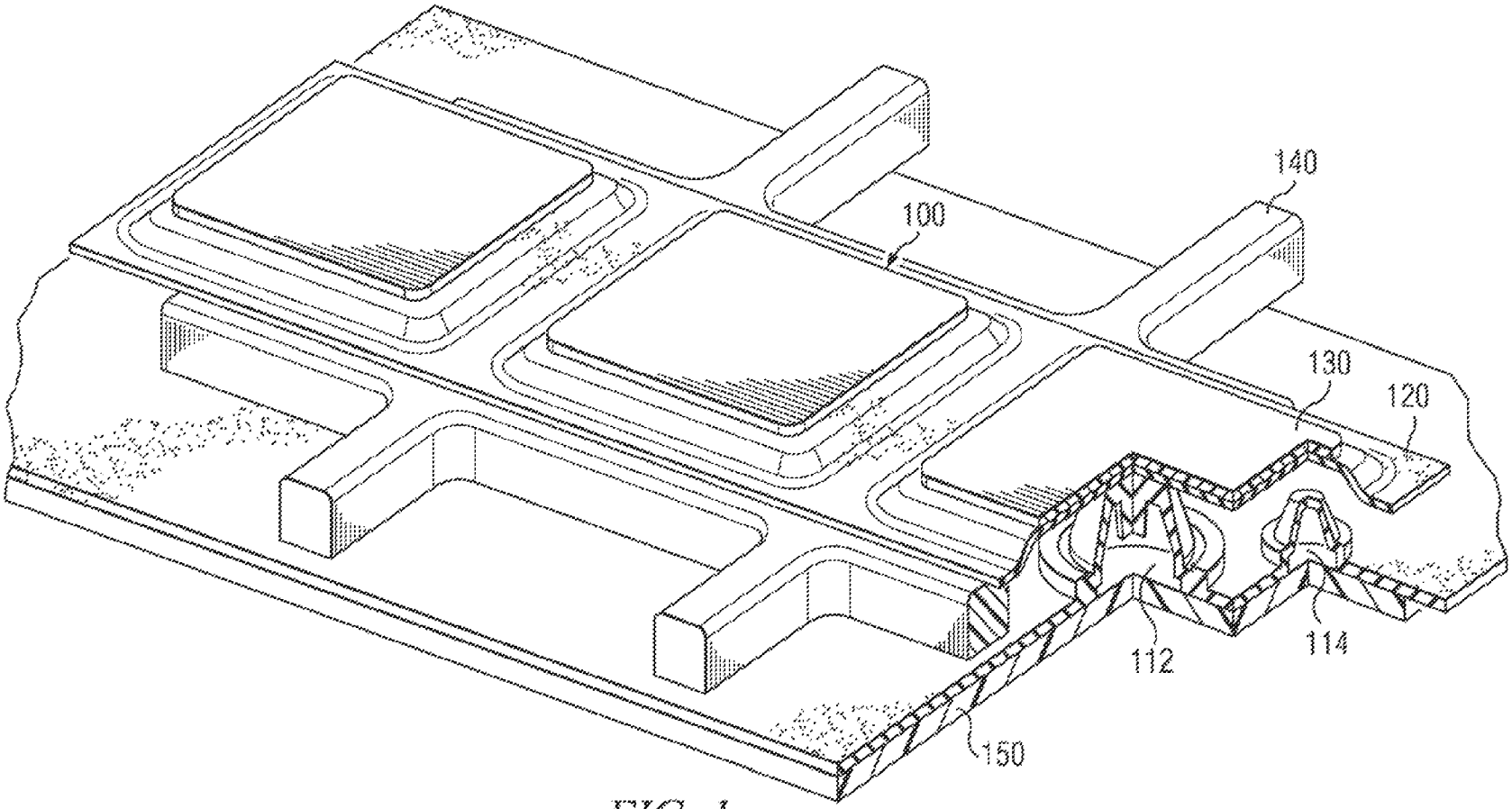
FIG. 1 is an example perspective cross-sectional view of a key.

Referring now to the drawings, FIG. 1 is an example perspective cross-sectional view of a key 100. FIG. 1 also show two other keys 100 and may represent a partial view of a keyboard having a plurality of keys 100. The key 100 and/or keyboard may be interface with a computing device (not shown). For example, one or more of the keys may input data, such as an alphabet letter, command, etc., to the computing device in response to being pressed by a user. Examples of the computing device include a chip set, a desktop computer, a workstation, a notebook computer, a slate computing device, a portable reading device, a wireless email device, or any other device capable of receiving and/or processing data.

In the embodiment of FIG. 1, the key 100 includes a dome layer 110 including primary dome 112, a plurality of secondary domes 114, a first layer 120, a second layer 130, a frame 140, and a base layer 150. The dome layer 110 and the first layer 120 may be made of one or more resilient materials, such as rubber. In addition, the dome layer 110 and the first layer 120 may also be formed as single continuous sheet and/or compression molded. As a result, at least manufacturing costs may be reduced and the key 100 may be resistant to damage from liquids. For example, if water is spilled on the key 100, at least one of the first layer 120 and the dome layer 110 may prevent the ingress of water to circuitry of one or more switches (not shown) included in the base layer 150.

The primary dome 112 is to provide a tactile response to a user and is to compress a switch (not shown) if the primary dome 112 collapses. For example, the primary dome 112 may hold up at least one of the first and second layers 120 and 130. If the user presses the key 100 via a sufficient downward force on at least one of the first and second layers 120 and 130, the primary dome 112 may collapse. Once the user sufficiently reduces or removes the downward force exerted on the key 100, the primary dome may return to its original form, thus pushing up again at least one of the first and second layers 120 and 130.

The first layer 120 is over the primary and secondary domes 112 and 114, with the first layer 120 substantially level or at substantially a same distance from the secondary domes 114 at a rest position. The rest position being a state at which the first layer is not acted upon by an external force, such as the user pressing the first layer 120 down towards the dome layer 110. The first layer 120 collapses the primary dome 112 and may not engage the secondary domes 114, if the first layer 120 is pressed substantially levelly or parallel to the rest position, Nonetheless, the secondary domes 114 may re-level the first and/or secondary layers 120 and 130 if the first and/or secondary layers 120 and 130 are pressed unevenly or not levelly, such as at angle. The term level may refer to a relatively uniform and/or horizontal plane in which any corners or edges of a surface along the plane have a relatively same height with respect to one another. The primary and secondary domes 112 and 114 will be described in further detail with respect to FIGS. 2 and 3.

Optionally, the second layer 130 may be over the first layer 120 and have a hardness greater than that of the first layer 120. As shown in FIG. 1, the second layer 130 may form discrete units over the first layer 120 and may act as a key stiffener or more responsive surface for the user. For example, the second layer 130 may allow for the first layer 120 over the primary dome 112 to be uniformly pressed and/or depressed when the user taps or presses the key 100. Nonetheless, the first layer 120 may still not be pressed levelly. For example, if the user presses the key 100 at an angle, such as by providing sufficiently more downward force towards and edge or corner of the key 100, rather than the center of the key 100, then the first and/or second layers 120 and 130 may not be displaced levelly. However, such displacement may be removed or reduced by the secondary domes 114, as explained above and further below with respect to FIGS. 2 and 3.

The second layer 130 may also display a letter, number, command, etc, via any display technique, such as lamination, embossing, and the like. While FIG. 1 shows the second layer 130 as over the first layer 120, embodiments are not limited thereto. For example, the second layer 130 may be between the primary dome 112 and the dome layer 110, In addition, embodiments may also exclude the second layer 130, such as when the first layer 120 alone has a sufficient hardness.

The frame 140 is over the dome layer 110 and is composed of a material having a hardness greater than that of the primary and secondary domes 112 and 114, such as plastic. The frame 140 may outline and support a shape of the key 100. In one embodiment, the frame 140 and the dome layer 110 may be co-molded.

The base layer 150 may include a backer plate (not shown) and a one or more switches (not shown). The backer plate may be formed of a rigid substance, such as metal or plastic, and provide structural support for the key 100. An operation of the switch will be described in further detail below.

Figure 2:
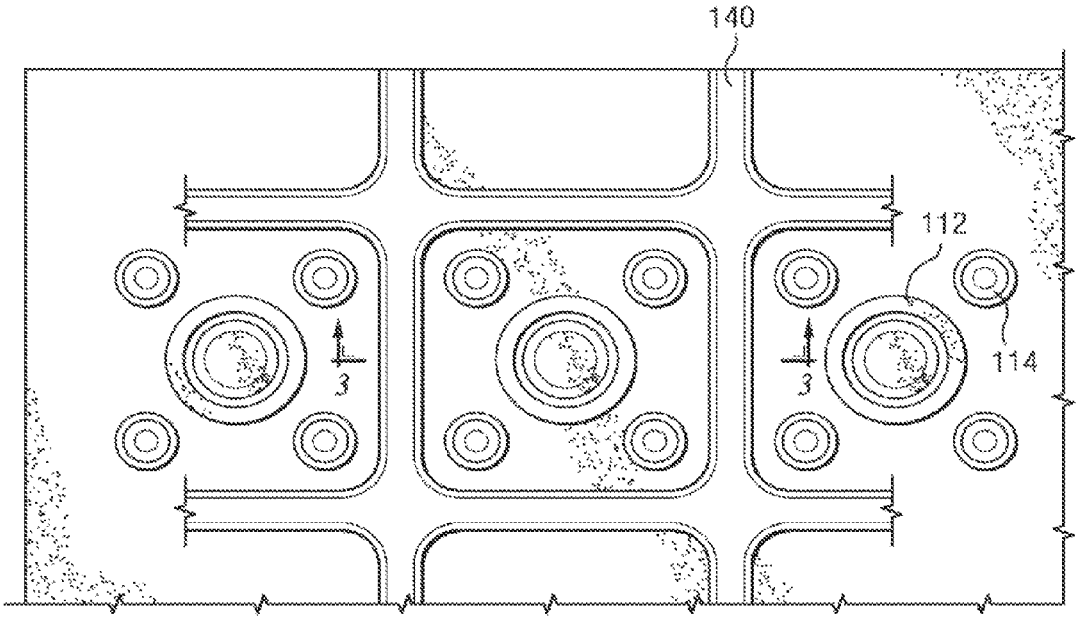
FIG. 2 is a top view exposing the domes and frame of the key of FIG. 1.

FIG. 2 is a top view exposing the domes 112 and 114 and frame 140 of the key 100 of FIG. 1. As shown in FIG. 2, the frame 140 surrounds the primary and secondary domes 112 and 114 of each key 100 and provides an opening to define a boundary for each of the keys 100. In FIG. 2, the primary and secondary domes 112 and 114 are circular or have a circular circumference. However, embodiments are not limited thereto. For example, the primary and/or secondary domes 112 and 114 may have a square, rectangular, triangular or irregular shape.

The secondary domes 114 surround the primary dome 112. In FIG. 2, a shape of the key 100 includes a plurality of corners and one of the secondary domes 114 is located at each of the corners. A distance between the primary and secondary domes 112 and 114 may be greater than a height the primary dome 112 when fully collapsed. However, embodiments may include various different positions for the secondary domes 114, such as along a center of each edge of the key 100. In addition, embodiments may include more or less than the four secondary domes 114 shown in FIG. 2.

Figure 3:
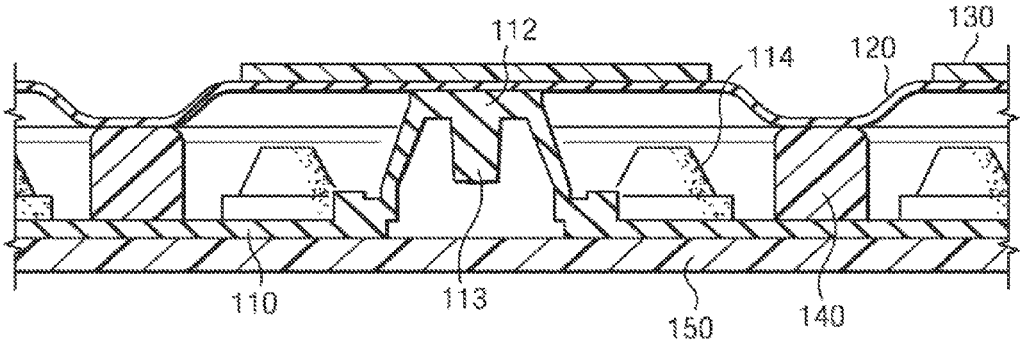
FIG. 3 is an example cross-sectional view along the line 3-3 of FIG. 2.

FIG. 3 is an example cross-sectional view along the line 3-3 of FIG. 2. As shown in FIG. 3, the primary dome 112 includes a pillar 113. The secondary domes 114 do not include pillars and are not collapsible.

When the user applies a downward force on the key 100, the force is transferred through the first and second layers 120 and 130 to the primary dome 112. When a threshold force is reached, the primary dome 112 begins to collapse. For example, the threshold force may be equivalent to a force exerted by 60 grams (gm) of mass. When the primary dome 112 collapses or is displaced a sufficient distance, such as approximately 14 millimeters (mm), the pillar 113 may apply sufficient contact with the base 150 to cause the switch associated with the key 100 to form a closed circuit.

For example, the switch may be a membrane switch composed of three layers, where two of the layers are membrane layers including conductive trace and the other layer is a spacer layer, such as an air gap, to keep the membrane layers apart. Thus, when the key 100 is not being pressed and the primary dome 112 is erect, the switch may be open because current cannot pass between the two membrane layers due to the spacer layer. However, when an upper of the membrane layers is pressed down by the pillar 113, the conductive traces of the membrane layers may make contact, thus allowing the circuit to dose and allow the key 100 to register being pressed to the computing device. Where there are plurality of such membrane switches, such as in a keyboard, the membrane switches may form a matrix to communicate to the computing device, for example, via a ribbon cable.

As shown in FIG. 3, the secondary domes 114 have a lower height than the primary dome 112. For example, a difference in height between primary dome 112 when fully erect and the secondary domes 114 may be approximately 1.6 mm. Thus, the secondary domes 114 may only be engaged after the primary dome 112 is engaged. The first layer 120 may engage the secondary domes 114 if the first layer 120 is at least one of pressed and depressed substantially not levelly or parallel to the rest position.

If the plurality of secondary domes 114 are engaged by the first layer 120, the secondary domes 114 will not generally collapse, unlike the primary dome 112. As a result, any of the secondary domes 112 engaged by the first layer 120, will prevent or reduce the first layer 120 from descending any further at a location of the engaged secondary domes 112. As a result, the first layer 120 will not become more unleveled and further, may become re-leveled as a remaining surface of the first layer 120 is pressed or pushed down.

As shown in FIG. 3, the first layer 120 is further over the frame 140, but a height of the first layer 120 is greater over the primary and secondary domes 112 and 114 than that of the frame 140. Such a raised profile may allow the key 100 to be more easily pressed and/or physically differentiable by the user. However, embodiments are not limited thereto. For example, embodiments may include the first layer 120 having a relatively same height over the over the primary and secondary domes 112 and 114 as well as the frame 140. Larger keys, such as a shift key or a space bar, may also include stabilizing wire (not shown).

Figure 4:
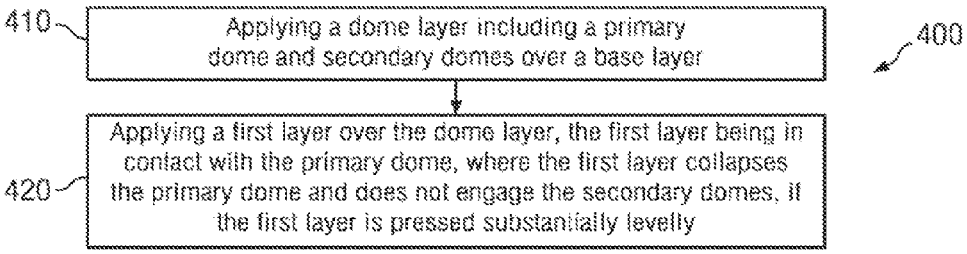
FIG. 4 is an example flowchart of a method for forming a key.

FIG. 4 is an example flowchart of a method 100 for forming the key. Although execution of method 400 is described below with respect to a single key 100, the method 400 may also be utilized for a plurality of keys, such as that of a keyboard.

In FIG. 4, at block 410, the dome layer 120 including the primary dome 112 and secondary domes 114 is applied over the switch. The switch may be a membrane switch and/or part of the base layer 150. Next, at block 420, the first layer 120 is applied over the dome layer 110, with the first layer 120 being in contact with the frame 140 and the primary dome 112. As noted above, the first layer collapses the primary dome 112 and does not engage the secondary domes 114, if the first layer 120 is pressed substantially levelly or parallel to the rest position. The dome layer 110 and the first layer 120 may be compression molded from an elastic material, such as rubber.

In addition, the frame 140 may be applied over the dome layer 110, before applying the first layer 120 at block 420. Alternatively, the dome layer 110 and the frame 140 may be applied simultaneously, with dome layer 110 and the frame 140 being co-molded. The frame 140 outlines the key 100 and surrounds the primary and secondary domes 112 and 114 of the key 100.

Further, a second layer 130 may be applied at least one of over the first layer 120 and between the first and dome layers 120 and 110. The hardness of the second layer 130 may be greater than that of the first layer 120 and the second layer 130 may not overlap with the frame 140. For example, the second layer 130 may include individual stiffeners that only cover an area within an opening in the frame 140 of the key 100.

With the above approaches, a key may provide a more simplified design with less parts that is less likely to become damaged during use while still providing stability when pressed down. In addition, the key may also reduce or prevent damage from external elements, such as liquids.

What is claimed is:

1. A key, comprising:

a primary dome to compress a switch if the primary dome collapses;

a plurality of secondary domes; and a first layer over the primary and secondary domes, the first layer at substantially a same distance from the secondary domes at a rest position, wherein the first layer collapses the primary dome and does not engage the secondary domes, if the first layer is pressed substantially parallel to the rest position; and wherein the plurality of secondary domes are to position the first layer parallel to the rest position if the first layer pressed substantially not parallel to the rest position.

2. The key of claim 1, wherein the first layer engages the secondary domes only if the first layer is pressed substantially not parallel to the rest position.

3. The key of claim 1, further comprising:

a frame surrounding the primary and secondary domes, wherein the frame is composed of a material having a hardness greater than that of the primary and secondary domes.

4. The key of claim 3, wherein, the first layer is further over the frame, and a height of the first layer is greater over the primary and secondary domes than that of the frame.

5. The key of claim 1, wherein the secondary domes have a lower height than the primary dome.

6. The key of claim 1, wherein the secondary domes are engaged after the primary dome is engaged.

7. The key of claim 1, further comprising:

a second layer, at least one of: over the first layer and between the primary dome and the first layer, wherein a hardness of the second layer is greater than that of the first layer.

8. The key of claim 1, wherein at least one of the primary and secondary domes are circular.

9. The key of claim 1, wherein the secondary domes surround the primary dome.

10. The key of claim 9, wherein a shape of the key includes a plurality of corners and at least one of the secondary domes is located at each of the corners.

11. A keyboard, comprising:

a plurality of the keys of claim 1, wherein at least one of the first layer and the primary and secondary domes of the keys are formed from single a sheet of elastic material.

12. A method for forming a key, comprising:

applying a dome layer including a primary dome and secondary domes over a base layer;

applying a first layer over the dome layer, the first layer being in contact with the primary dome; and applying a second layer at least one of: over the first layer and between the primary dome and the first layer, wherein a hardness of the second layer is greater than that of the first layer, and wherein the first layer collapses the primary dome and does not engage the secondary domes, if the first layer is pressed substantially levelly, and wherein the plurality of secondary domes are to position the first layer parallel to the rest position if the first layer pressed substantially not parallel to the rest position.

13. The method of claim 12, further comprising:

applying a frame over the dome layer, the frame outlining the key and surrounding the primary and secondary domes of the key.

14. The method of claim 13, wherein:

the second layer does not overlap with the frame.

* * * * *